US005265391A

United States Patent [19]

Ricard et al.

[11] Patent Number: 5,265,391

[45] Date of Patent: Nov. 30, 1993

[54] STABILIZED MODULAR SHUTTER

[75] Inventors: Michael J. Ricard, Prospect Heights, Ill.; Alan MacGowan, Walworth, Wis.

[73] Assignee: Selfix, Inc., Chicago, Ill.

[21] Appl. No.: 966,896

[22] Filed: Oct. 26, 1992

Related U.S. Application Data

[63] Continuation of Ser. No. 890,399, May 26, 1992, abandoned, which is a continuation of Ser. No. 708,479, May 31, 1991, abandoned.

[51] Int. Cl.[5] ..... E06B 7/06

[52] U.S. Cl. ..... 52/455; 52/473

[58] Field of Search ..... 52/455, 473, 514

[56] References Cited

U.S. PATENT DOCUMENTS

| | | | |
|---|---|---|---|
| 165,812 | 7/1875 | Fletcher | 52/473 |
| 1,580,754 | 2/1923 | Mularcik . | |
| 1,701,695 | 2/1929 | Paine | 49/74 |
| 1,771,304 | 7/1930 | MacGruder . | |
| 3,055,467 | 9/1962 | Peek et al. | 52/473 |
| 3,086,442 | 4/1963 | Waldron | 52/473 |
| 3,158,909 | 12/1964 | Downs | 52/473 |
| 3,191,242 | 6/1965 | Rauen . | |
| 3,394,518 | 7/1968 | Worrell, Jr. | 52/473 |
| 3,455,079 | 7/1969 | Frederick | 52/473 |
| 3,548,555 | 12/1970 | Trostle | 52/473 |
| 3,797,186 | 3/1974 | Smith | 52/473 |
| 3,802,146 | 4/1974 | Tacke et al. | 52/220 |
| 3,936,985 | 2/1976 | Marulli | 52/660 |
| 3,968,738 | 7/1976 | Matzke | 52/473 |
| 4,251,966 | 2/1981 | Foltman | 52/473 |
| 4,765,110 | 4/1988 | MacLeod | 52/473 |
| 4,967,511 | 11/1990 | Werginz et al. | 49/371 |

FOREIGN PATENT DOCUMENTS

| | | | |
|---|---|---|---|
| 9990 | 6/1980 | Fed. Rep. of Germany | 52/473 |
| 792951 | 11/1935 | France | 52/473 |
| 2257771 | 8/1975 | France | 52/473 |

OTHER PUBLICATIONS

Letter from Mid-America Building Products Corp. dated Mar. 1992 with enclosures.

*Primary Examiner*—James L. Ridgill, Jr.

*Attorney, Agent, or Firm*—Dressler, Goldsmith, Shore, Sutker & Milnamow, Ltd.

[57] ABSTRACT

Modular shutter constructed of modular components including side rails, end rails, and a central generally planar panel member, and including a stabilizing member disposed between the edge of said central panel member and adjacent end rails and connectable therebetween for maintaining the relative positioning therebetween and including a portion for covering any gap between the edge of said central panel member and the adjacent end rail.

8 Claims, 2 Drawing Sheets

Fig. 1
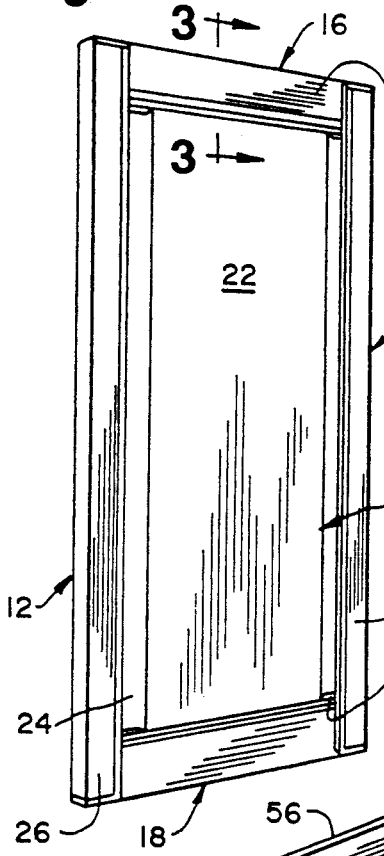
Fig. 3
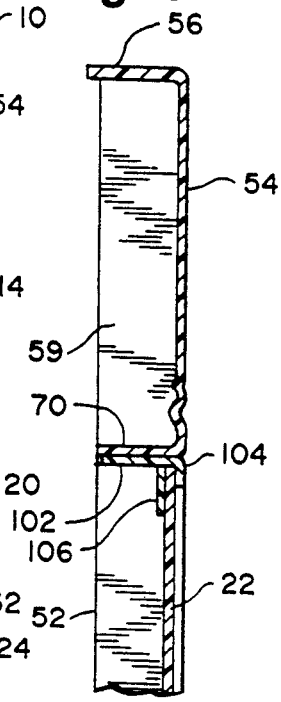
Fig. 2
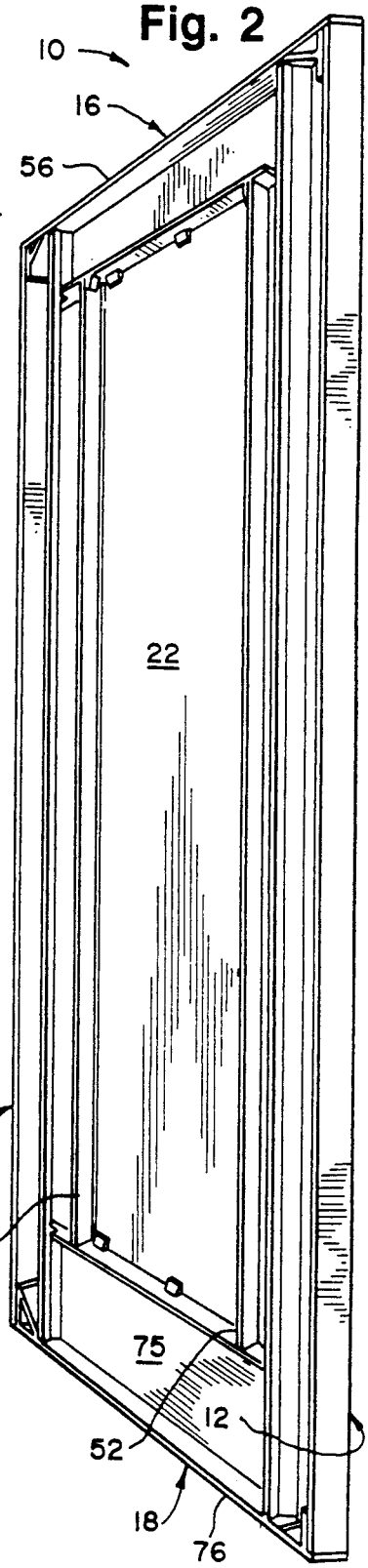
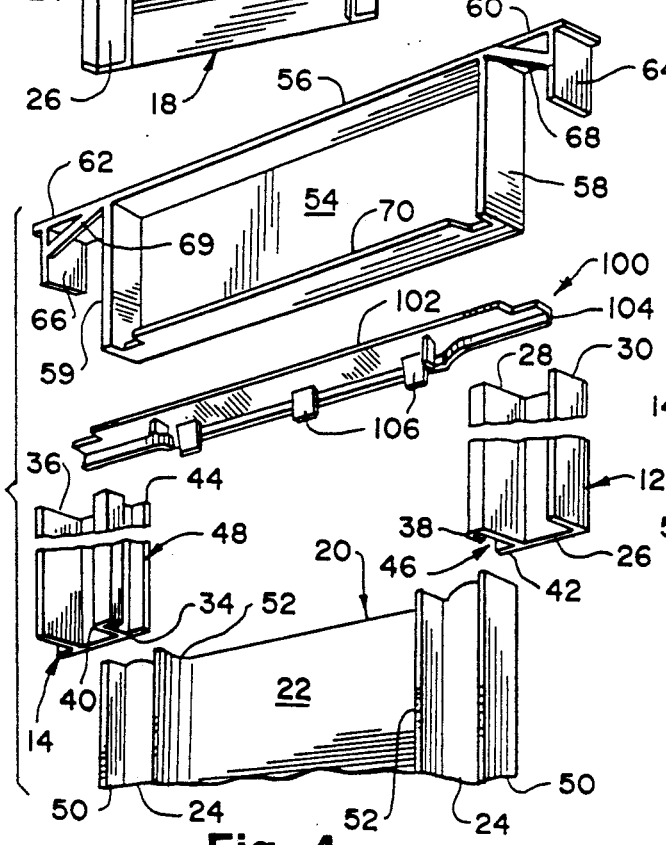
Fig. 4

STABILIZED MODULAR SHUTTER

This application is a continuation of application Ser. No. 07/890,399, filed May 26, 1992, now abandoned.

FIELD OF THE INVENTION

This invention pertains to shutters for buildings and more particularly to modular shutters.

BACKGROUND OF THE INVENTION

A variety of shutters are available for installation adjacent to openings in the walls of building structures. Such shutters may be constructed from a variety of materials.

For example, shutters are often formed as integral one-piece units of a predefined size. Alternatively, shutters may be assembled from modular components. Such modular shutters provide flexibility not available with the one-piece unitary structures. Different sizes of modular shutters can be assembled from common components, thus reducing the quantity of different parts in inventory. The length and width of modular shutters may be changed by substitution of some of the components, or by cutting some of the parts to an appropriate length. In this way, the size of modular shutters can be selected to match the size of the adjacent opening.

One example of a modular adjustable shutter constructed of plastic is shown in Foltman U.S. Pat. No. 4,251,966. The modular shutter disclosed in the Foltman patent is representative of the general arrangement of components in adjustable modular shutters.

Typically, modular shutters are assembled with a pair of side rails, top and bottom end rails, and one or more center panels that may take the form of louvered or generally planar panel members. Depending upon the size of the shutter, more than one center panel may be used separated by one or more center end rails inserted between the adjacent ends of the center panels.

Typically, when the various components of a modular shutter are assembled, they are attached to each other in order to provide rigidity and to keep the assembled components together. When modular shutters are formed with generally planar central panel members, the rigidity and stability of the resulting assembly is not always what might be desired.

In modular shutters made from plastic, the side rails and the raised center panels are molded and/or extruded to uniform lengths. When a modular shutter is assembled, the side rails and the center panels are cut to a desired length. These cut-to-size components are assembled with top and bottom end rails and center end rails (when used) to form a modular shutter.

Since the lengths of the side rails and the center panels vary as a function of the desired length of a modular shutter, the configuration of these components are generally uniform in cross section along their length. It is not always possible to provide cross braces, strengthening members, or end walls because the ultimate length of the rails and panels is undetermined when those components are produced. When assembled, the ends of the center panels, which are not affixed to the end rails, may flex and become distorted or warped over time.

Furthermore, since the planar panels are continuous and are not formed with intermittent spaces of the type that exist in louver type panels, any gap between the ends of planar type center panels and the adjacent end rails is more noticeable. Such undesirable gaps may be accentuated by deformation of the planar panel members and could result in a relatively unsightly appearance.

It would be desirable, therefore, eliminate gaps from between the ends of the center panels and the adjacent end rails and also enhance the strength, rigidity and appearance of the shutter assembly.

SUMMARY OF THE INVENTION

In accordance with the present invention, there is provided a stabilized modular shutter of the type utilizing generally planar center panels framed by a pair of side rails, top and bottom end rails, and, if appropriate, center end rails. The modular shutter incorporating the present invention includes a stabilizing member disposed between at least one end of the center panel and the adjacent end rail and connected thereto for stabilizing the shutter assembly, for stiffening the center panel, and for facilitating connection thereof to the adjacent end rails.

A stabilizing member in accordance with the present invention typically is shaped complementary to the shape of the center panel including any decorative indentations or troughs formed, for example, along the sides of the panels. In accordance with the present invention, the stabilizing member is typically positioned between each end of a center panel and an adjacent end rail. The stabilizing member may include an enlarged decorative bead or gap closing portion disposed along the front edge thereof to cover the gap that normally exists between the ends of the center panel and the adjacent end rails. The exposed surface of the gap closing portion may provide a decorative appearance in addition to covering any gap that may exist therebetween.

In accordance with the present invention, the stabilizing member includes a generally planar flange portion oriented generally transverse to the plane of the center panel with an enlarged decorative outer portion extending along the exposed or front edge thereof and corresponding in shape to the shape of the center panel. The decorative gap closing portion may include a lip extending over the edge of the center panel.

A plurality of depending flanges spaced from the decorative gap closing portion extend behind the center panel to retain the edge of the center panel therebetween and position the stabilizing member relative to the center panel. The transverse flange of the stabilizing member is designed to abut the corresponding transverse interior end wall of the adjacent end rail and is attachable thereto to make a connection therebetween. Thus, the stabilizing member interconnects the center panel and the adjacent end rail.

The components of the resulting modular shutter produced maintain a stable positional relationship with each other. The stabilized modular shutter is relatively rigid, avoids unsightly gaps between the various components and maintains a desired decorative appearance and rigidity without appreciably adding to the cost or complexity of assembly.

Numerous other features and advantages of the present invention will become readily apparent from the following detailed description of the invention and an embodiment thereof, from the claims, and from the accompanying drawings in which the details of the invention are fully and completely disclosed as a part of this specification.

BRIEF DESCRIPTION OF THE DRAWINGS

FIG. 1 is a front perspective view of a stabilized modular shutter incorporating the present invention;

FIG. 2 is an enlarged rear perspective view thereof;

FIG. 3 is an enlarged sectional view taken along the line 3—3 of FIG. 1;

FIG. 4 is a partial enlarged exploded view of the components at one end thereof;

DETAILED DESCRIPTION OF THE PREFERRED EMBODIMENTS

Figure 5:
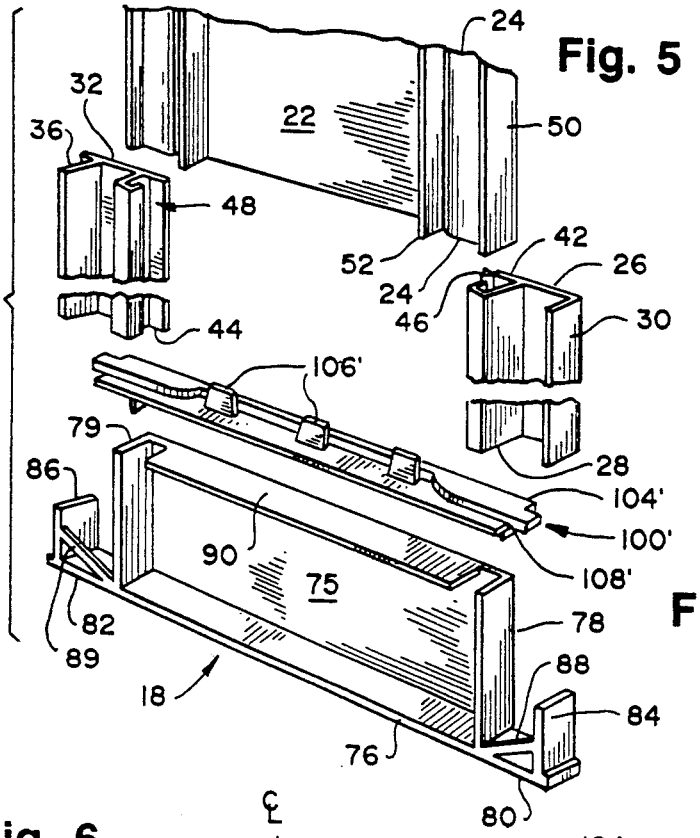
FIG. 5 is an enlarged partial exploded view showing components of an alternative embodiment at the other end thereof.
Figure 8:
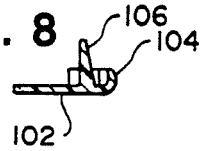
FIG. 8 is a sectional view taken along line 8—8 of FIG. 7.
Figure 6:
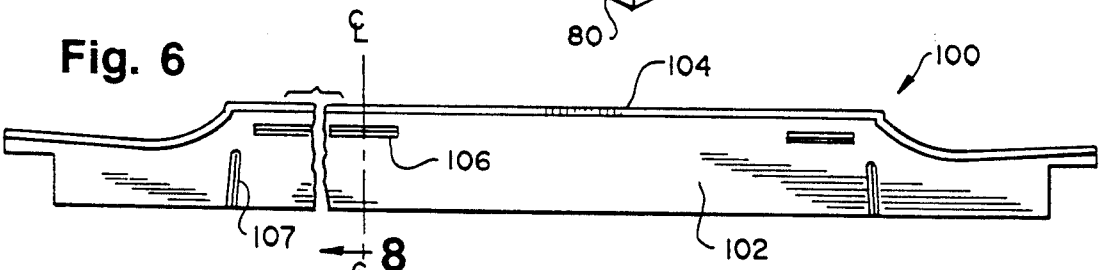
FIG. 6 is a bottom plan view of a stabilizing member in accordance with the present invention.
Figure 7:
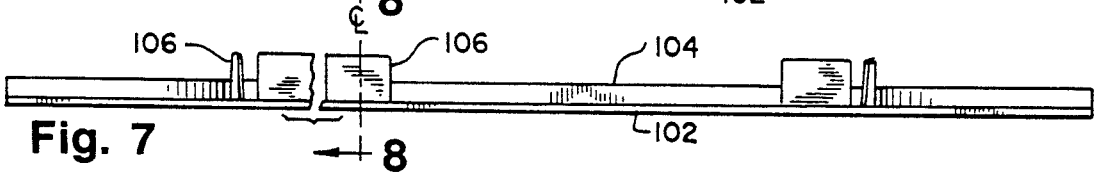
FIG. 7 is a rear elevational view thereof.
Figure 9:
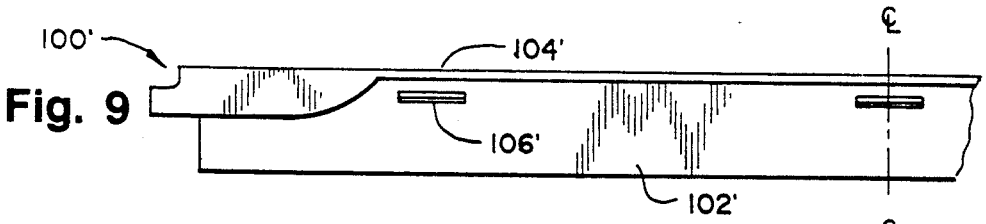
FIG. 9 is a bottom plan view of an alternative embodiment of the stabilizing member.
Figure 10:
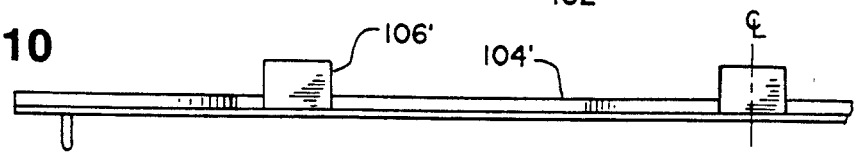
FIG. 10 is a rear elevational view of the embodiment of FIG. 9.

While the present invention is susceptible of embodiment in various forms, there is shown in the drawings, and will be hereinafter described, a preferred embodiment of the invention and alternative embodiments thereof with the understanding that the present disclosure is to be considered as an exemplification of the principles of the invention and is not intended to limit the invention to the specific embodiments illustrated.

As shown in the drawings, the stabilized modular shutter 10 incorporating the present invention is comprised of a plurality of modular members including left and right side rails 12, 14, respectively, top and bottom end rails 16, 18, respectively, and a central panel member 20 having a generally planar central portion 22 and shaped, recessed, decorative side portions 24.

Left side rail 12 has a front wall 26, an inner side wall 28, and an outer side wall 30, the side walls 28, 30 extending rearwardly from the front wall 26. Right side rail 14 has a front wall 32, an inner side wall 34, and an outer side wall 36, the side walls 32, 36 extending rearwardly from the front wall 32.

Each of the inner side walls 28, 34 terminates in a rear hook shaped retaining portion 38, 40, respectively. Each of the front walls 26, 32 of the side rails 12, 14, respectively, includes a generally planar retaining portion 42, 44 extending inwardly from the corresponding inner side wall 28, 34. The retaining portions 42, 44 define with the corresponding rear hook portions 38, 40 mounting channel portions 46, 48.

The central panel member 20 is, as shown, substantially planar although it can incorporate shaped recessed, decorative side portions 24 along either side thereof. A pair of runners 50 oriented substantially transverse to the plane of the central planar portion 22 provided on either side of the central panel member 20. Longitudinal stiffening members or ribs 52 can be provided along the length of the central panel member 20, e.g., at the junctions of the central planar portion 22 and the shaped, recessed side portions 24.

The stabilized modular shutter 10 is assembled by outting the side rails 12, 14 and the central panel member 20 to a desired length. The central panel member 20 will be shorter to accommodate the upper and lower end rails 16, 18. Depending upon the length of the shutter, one or more intermediate or central end rails can be utilized between plural adjacent panel members 20 although in the embodiment shown in the drawing, such a central end rail is not shown.

The top end rail 16 includes a front wall 54, and an external end wall 56. A pair of side walls 58, 59 extend rearwardly from the front wall 54 to define runners receivable in the left and right side rail channels 46, 48. The external top wall 56 extends laterally beyond the side walls 58, 59 to define left and right wing portions 60, 62 designed to cover the exposed end of the corresponding side rails 12, 14, respectively. Each of the wings 60, 62 includes a depending flange 64, 66, respectively, which is insertable into the corresponding open end of a corresponding side rail 12, 14. Bracing members 68, 69 may be included to maintain the rigidity of each of the flanges when inserted into the open ends of the side rails 12, 14.

The top end rail 16 includes an internal end wall 70 extending rearwardly from the lower edge of the front wall 54. The internal end wall 70 terminates short of the side walls 58, 59 to form gaps to receive the rear hooks 38, 40 when the side wall runners 58, 59 are inserted into the channels 46, 48.

The bottom end rail 18 includes a front wall 75, and an external end wall 76. A pair of side walls 78, 79 extend rearwardly from the front wall 75 to define runners receivable in the left and right side rail channels 46, 48. The external end wall 76 extends laterally beyond the side walls 78, 79 to define left and right wing portions 80, 82 designed to cover the exposed end of the corresponding side rails 12, 14, respectively. Each of the wings 80, 82 includes a depending flange 84, 86, respectively, which is insertable into the corresponding open end of a corresponding side rail 12, 14. Bracing members 88, 89 may be included to maintain the rigidity of each of the flanges when inserted into the open ends of the side rails 12, 14.

The bottom rail 18 includes an internal end wall 90 extending rearwardly from the upper edge of the front wall 75. The internal end wall 90 terminates short of the side walls 78, 79 to form gaps to receive the rear hooks 38, 40 when the side wall runners 78, 79 are inserted into the channels 46, 48.

A stabilizing member 100 includes a flange or planar portion 102 oriented substantially transverse to the plane of the central panel member 20 and generally parallel to the internal end wall 70 of the top end rail 16. The stabilizing member 100 also includes an enlarged, decorative gap covering bead or lip 104 which extends along the front edge of the stabilizing member 100. The front edge 104 of the stabilizing member has a shape complementary to the shape of the center panel member 20. The decorative lip 104 partially overlies the edge of the center panel 20 and is enlarged to cover any gap that may exist between the end of the center panel 20 and the interior end wall 70 of the top end rail 16. A plurality of stabilizing retaining tabs 106 are positioned adjacent to but spaced rearwardly of the decorative lip portion 104 and are disposed behind the center panel 20 when the stabilizing member 100 is in place at the end of the center panel. As shown in the drawings, the stabilizing member 100 does not include complete runners for insertion into the side rail channels 46, 48. The rear corners of the stabilizing flange 102 are notched to provide access for the rear hook portions 38, 40 on the inner side walls 28, 34 of side rails 12, 14. As shown in the drawings, the stabilizing member 100 is inserted between the end of the center panel 20 and the interior end wall 70 of the adjacent top end rail 16 and is retained in position therebetween. The relative position of the stabilizing member 100 and the center panel 20 is achieved by capturing the upper edge of the center panel between the decorative lip 104 and the retaining tabs 106. Additional retaining tabs 107 extending generally transverse thereto engage the stiffening members 52 of the center panel to prevent relative lateral movement therebetween and thereby ensure stable positional relationship between the stabilizing member and the center panel. The wall 70 of the end rail 16 presses against the stabilizing flange 102 to hold the stabilizing member 100 in place.

If desired, the internal end wall 70 of the end rail 16 can be attached to the stabilizing flange 102, such as by staples or any of the other usual fastening devices utilized for shutter assembly.

The front edge and bead 104 of the stabilizing member 100, as shown in FIG. 4 is configured to conform to the shape of the recessed side portions 24 of the center panel 20 to provide a finished appearance to the entire extent of the center panel.

Alternatively, the decorative front edge of the stabilizing member can be configured to follow the edge of the end rail and be generally uniform along its entire extent. Thus, as shown in FIG. 5, the stabilizing member 100' will be notched to once again ensure the relative positioning of the stabilizing member relative to the end of the center panel 20 to inhibit relative movement therebetween. Thus, the stabilizing member provides a center panel receiving recess 108' between the decorative gap shielding lip 104' on the front edge thereof and the retaining tabs 106' positioned adjacent thereto and rearwardly therefrom.

Thus, there has been disclosed in accordance with the present invention a stabilized modular shutter in which a generally planar center panel is maintained in relatively stable position to the end rails abutting either end thereof by utilizing stabilizing members that are at the end of the center rails located between the end of the center rail and the adjacent end cap which are maintained in stable position relative to the center panel and which are attachable to the end rail to facilitate the production of an overall relatively stable presentable modular shutter. The use of the stabilizing member provides a vehicle for providing the desired rigidity and inhibiting relative movement and distortion of the center panel once the modular shutter has been assembled and provides a convenient and low-cost way for producing a shutter having the desired structural stability as well as improving the appearance and minimizing the existence of unsightly and undesirable gaps between adjacent components.

From the foregoing, it will be observed that numerous variations and modifications may be effected without departing from the true spirit and scope of the novel concept of the invention. It is to be understood that no limitation with respect to the specific apparatus illustrated herein is intended or should be inferred. It is, of course, intended to cover by the appended claims all such modifications as fall within the scope of the appended claims.

What is claimed is:

1. A modular shutter comprising: a pair of side rail members, each including inwardly facing side wall portions containing runner receiving and retaining means;

a panel member having a generally planar central portion and runner portions disposed along the sides of said panel member and oriented generally transverse to the plane of said central planar panel portion, said runner portions being receivable in said runner receiving and retaining means;

an end rail having runner portions receivable in said side rail runner receiving and retaining means, said end rail being disposed at an end of said panel member for enclosing said panel member end, said end rail having a generally planar front wall portion and an end wall portion oriented substantially transverse thereto, said end wall portion being disposed adjacent one end of said panel member; and a stabilizing member disposed between the adjacent ends of said panel member and said end rail for connecting said panel member to said end rail to minimize relative movement therebetween.

2. A modular shutter as claimed in claim 1 wherein:

the major portion of said generally planar front wall of said end rail is oriented generally parallel to the plane of the planar central portion of said panel member.

3. A modular shutter as claimed in claim 2 wherein:

the decorative portion of said stabilizing member conforms in shape to the shape of said panel member.

4. A modular shutter as claimed in claim 1 wherein:

said stabilizing member includes an exposed decorative portion located along the exposed front edge thereof between said end rail and said panel member, and a generally planar flange portion oriented transverse to the plane of said panel member and connectable to an adjacent transverse internal wall of said end rail.

5. A modular shutter as claimed in claim 4 including:

retaining means formed on the transverse flange of said stabilizing member positionable behind the end of said panel member for retaining said panel member in place relative to said stabilizing member.

6. A modular shutter as claimed in claim 5 wherein:

said retaining means comprises a plurality of tabs formed on said transverse flange of said stabilizing member and spaced rearwardly of the front edge thereof for receiving and retaining the edge of said panel member between the decorative portion and said tabs.

7. A modular shutter comprising:

a pair of side rail members, each side rail member including a front wall, an outer side wall extending rearwardly from said front wall, and an inner side wall extending rearwardly from said front wall and containing runner receiving and retaining means in the form of a channel;

a central panel member having a generally planar central portion and recessed side portions on either side thereof, said panel member further including runner portions disposed along the sides thereof and oriented generally transverse to the plane of said central planar panel portion, said runner portions being receivable in said channels formed on the inner walls of said side rail members;

end rails having runner portions receivable in said channel portions of said side rails, said end rails being disposed at either end of said panel member for enclosing said panel member ends, said end rails having generally planar front wall portions, outer end wall portions having extensions for covering the exposed ends of said side rails, and an internal end wall disposed adjacent the end of said central panel member;

a stabilizing member disposed between the ends of said central panel member and an adjacent end rail, said stabilizing member including a flanged portion oriented generally parallel to and disposed adjacent the internal end wall of said end rail and having a portion at the forward edge thereof for covering the adjacent edge of said central panel member and closing the gap between the adjacent ends of said central panel and said end rail, said stabilizing flange being connectable to said adjacent internal end wall of said end rail retaining stabilizing means between said end rail, said stabilizing means, and said adjacent end of said central panel member.

8. A modular shutter as claimed in claim 6 including:

a plurality of retaining means formed on said stabilizing member in position to capture the edge of said panel member between the front thereof and said retaining members.

* * * * *